United States Patent [19]

Horikawa et al.

[11] Patent Number: 4,651,388

[45] Date of Patent: Mar. 24, 1987

[54] SLIDING CLASP FASTENER

[75] Inventors: Mitsuo Horikawa, Kurobe; Akinobu Terasawa, Uozu, both of Japan

[73] Assignee: Yoshida Kogyo K.K., Tokyo, Japan

[21] Appl. No.: 776,151

[22] Filed: Sep. 13, 1985

[30] Foreign Application Priority Data

Sep. 14, 1984 [JP] Japan ..... 59-139789

[51] Int. Cl.[4] ..... A44B 19/02

[52] U.S. Cl. ..... 24/409; 24/410; 24/411

[58] Field of Search ..... 24/388, 409, 410, 411, 24/433, 434, 435

[56] References Cited

U.S. PATENT DOCUMENTS

| | | | |
|---|---|---|---|
| 17,881 | 11/1930 | Winterhalter | 24/411 |
| 1,610,839 | 12/1926 | Winterhalter | 24/411 |
| 1,692,196 | 11/1928 | Blair | 24/411 |
| 2,440,007 | 4/1948 | Frank | 24/410 |
| 2,489,718 | 11/1949 | Morin | 24/410 X |

FOREIGN PATENT DOCUMENTS

| | | | |
|---|---|---|---|
| 884631 | 7/1953 | Fed. Rep. of Germany | 24/409 |
| 58-116946 | 7/1983 | Japan . | |
| 361759 | 11/1931 | United Kingdom | 24/411 |
| 488329 | 7/1938 | United Kingdom | 24/411 |
| 535609 | 4/1941 | United Kingdom | 24/409 |
| 696368 | 8/1953 | United Kingdom | 24/411 |

*Primary Examiner*—Kenneth J. Dorner
*Assistant Examiner*—Laurie K. Cranmer
*Attorney, Agent, or Firm*—Hill, Van Santen, Steadman & Simpson

[57] ABSTRACT

A sliding clasp fastener which is provided has a pair of sliders for opening and closing the fastener in the forward direction and in the reverse direction, respectively. The fastener has a series of discrete coupling elements each having means for facilitating engagement of adjacent elements with minimum frictional resistance when the fastener is opened or closed in the reverse direction, such means comprising a pocket having a front end wall sloping at the outside of the pocket and being reinforced by rib means inside the pocket.

3 Claims, 11 Drawing Figures

SLIDING CLASP FASTENER

BACKGROUND OF THE INVENTION

1. Field of the Invention

This invention relates to a sliding clasp fastener, more particularly to such a fastener which can be opened and closed in either of two reciprocal directions.

2. Prior Art

A variety of sliding clasp fasteners or zippers are known which are equipped with a pair of sliders, providing an option for the user to manipulate either of the two sliders to open or close the fastener from either direction. Such fasteners have coupling elements formed by press, injection or die-casting into a symmetrical mating structure, the element in a row on one stringer tape having a prong engageable with a groove in the corresponding element on the opposite tape. One problem posed by such form of coupling elements is that while the fastener is smoothly operative with the slider moving in one or the forward direction, the operation becomes sluggish or otherwise defective when the slider is moved in the other or the reverse direction account of the prong on one stringer getting jammed in the groove or severely striking against the front end wall of the groove on the mating stringer.

A means for coping with this problem is disclosed in Japanese Laid-Open Patent Publication 58-116946 wherein the coupling element is dented at an outer marginal edge of the groove so as to reduce interacting impact with the mating prong. However, such an element structure lacked, due to reduced contact area, an element-to-element coupling strength sufficient to withstand lateral pull or stresses applied perpendicularly to the plane of the fastener. Another difficulty was that the front end wall defining the groove is susceptible to deformation by repeated impinging contact with the corresponding prong, resulting in weakened interengagement of the fastener stringers.

SUMMARY OF THE INVENTION

With a view to overcoming the foregoing difficulties of the prior art, the present invention is a sliding clasp fastener which can be opened and closed from either direction by a pair of sliders and which carries coupling elements mutually engageable or disengageable with least frictional resistance even when the slider is moved along the fastener in the reverse direction.

Another important object of the invention is to provide a sliding clasp fastener having a pair of stringers which can be coupled together with sufficient strength to withstand stresses applied in a direction parallel or perpendicular to the plane of the fastener.

According to the invention, a sliding clasp fastener has coupling elements each including at one of its ends mounting portions and at the opposite end a coupling head portion, said head portion having an engaging prong and a pocket complementary in shape with the contour of said prong, said element having a front end wall contiguous with said head portion and defining said pocket, said front end wall having an outer marginal surface tilted downwardly to form a guide slope and including a rib projecting from the inner surface of said end wall.

The invention will be better understood from the following description taken in conjunction with the accompanying drawings which illustrates by way of example some preferred embodiments of the invention.

Like reference numerals refer to like or corresponding parts throughout the several views.

DETAILED DESCRIPTION OF THE PREFERRED EMBODIMENTS

Figure 1:
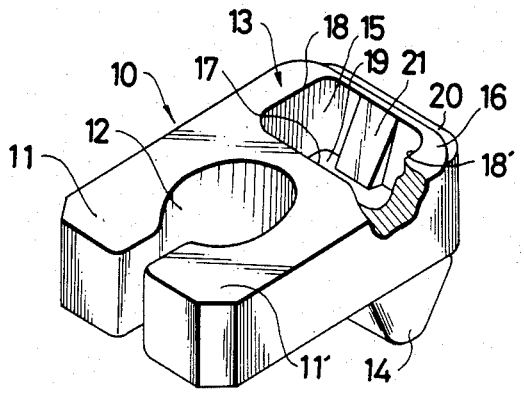
FIG. 1 is a perspective view of one of a series of discrete coupling elements embodying the invention.
Figure 2:
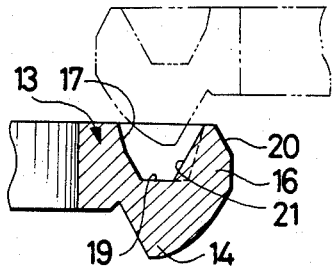
FIG. 2 is a longitudinal cross-sectional view of a coupling head portion of the element of FIG. 1.
Figure 8:
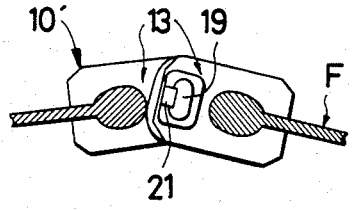
FIG. 8 is a transverse cross-sectional view of a sliding clasp fastener shown under the influence of stresses applied upwardly in a direction perpendicular to the plane of the fastener.

In FIGS. 1 and 2 there is shown an individual coupling element 10, it being one of a series of discrete formations embodying the present invention. The coupling element 10 is generally rectangular in shape and has at one of its ends opposed leg portions 11, 11' defining therebetween a substantially oblong aperture 12 for receiving, as is well known, a beaded edge of a stringer tape as shown in FIG. 8. At the opposite end of the coupling element 10 is formed a coupling head portion 13 which includes an engaging prong 14 and a receiving groove or pocket 15 complementary in shape with the contour of the prong 14 as better shown in FIG. 2. The pocket 15 is defined by a front end wall 16, a rear end wall 17, side walls 18, 18' and a bottom wall 19, the bottom wall 19 being contiguous with the engaging prong 14. The front end wall 16 has an outer marginal surface tilted downwardly to form a guide slope 20 substantially coextensive with the width of the wall 16 for purposes to be hereafter described. There is formed a rib 21 integral with and projecting from the inner surface of the front end wall 16 and having a thickness increasing progressively toward the bottom wall 19 of the pocket 15, the rib 21 serving to provide reinforcement of the element 10 as hereafter described.

Figure 3:
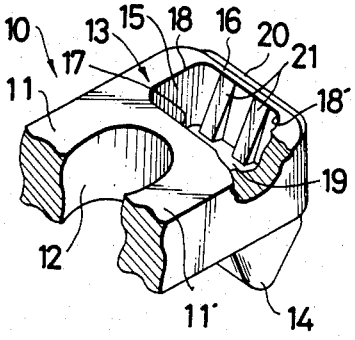
FIG. 3 is a perspective view of a modified form of a coupling element according to the invention.

FIG. 3 shows a modified form of coupling element 10 which is substantially the same in construction as that of FIG. 1 and 2 except that there are provided two laterally spaced ribs 21.

Figure 10:
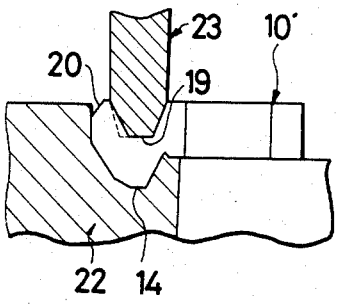
FIG. 10 is a cross-sectional view of a punch and die apparatus employed to form the coupling element of FIG. 1.
Figure 11:
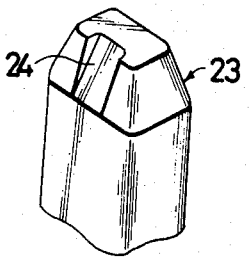
FIG. 11 is a perspective view of the punch of FIG. 10.

The coupling elements 10 shown in FIGS. 1, 2 and 3 may be most conveniently and suitably formed by a press or by die-casting. The coupling element 10 of FIG. 1 in particular may be made by an apparatus shown in FIG. 10 which comprises a stationary die 22 and a movable punch 23. A starting material of continuous length (not shown) may be provided at predetermined intervals with the guide slopes 20 conveniently at the stage of punching out or cutting into individual element blocks. This block 10' is placed on the die 22 and worked by the punch 23 as shown in FIG. 10 whereby the coupling head portion 13 is produced with the prong 14 formed with the material that has moved from the pocket 15, and at the same time with the rib 21 formed by a complementary recess 24 in the punch 23. The presence of the recess 24 is important as it serves to retain the desired dimensions of the guide slope 20, and were it not for such a recess, the slope 20 would be reduced in size or otherwise deformed as a result of the movement of the material from the pocket 15.

Figure 4:
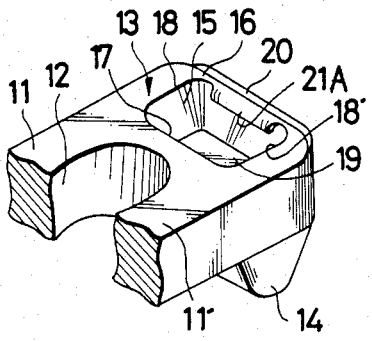
FIG. 4 is a perspective view of another modified form of coupling element according to the invention.
Figure 5:
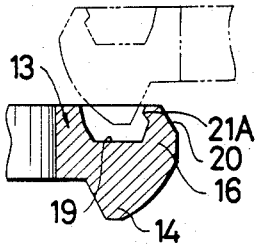
FIG. 5 is a longitudinal cross-sectional view of a portion of FIG. 4.

FIGS. 4 and 5 show another modification of coupling element 10 which may be formed by injection or die-casting and which is substantially the same as that of FIG. 1 except that there is a laterally elongated rib 21A which is formed along the inner upper marginal edge of the front end wall 16.

Figure 6:
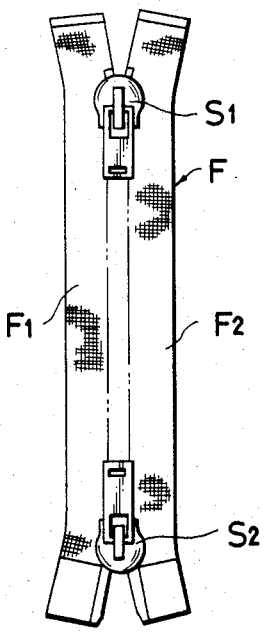
FIG. 6 is a plan view of a sliding clasp fastener having the coupling elements embodying the invention and a pair of sliders.
Figure 7:
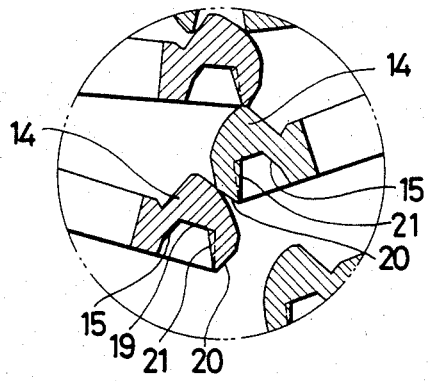
FIG. 7 is a schematic cross-sectional view on enlarged scale of adjacent coupling elements showing the same in coupling condition within the interior of a reversely operated slider.

In FIG. 6, there is shown a complete sliding clasp fastener F which comprises a pair of identical stringers $F_1$ and $F_2$ each carrying along its longitudinal beaded edge a series of discrete coupling elements 10 of the construction above described and a pair of sliders $S_1$ and $S_2$ respectively positioned at the opposite ends of the fastener. The upper slider $S_1$ opens and closes the fastener F in the forward direction. The lower slider $S_2$ is the one which opens and closes the fastener F in the reverse direction, in which instance the coupling elements 10 embodying the invention function as desired. The behavior of adjacent coupling elements 10 on the opposed stringers $F_1$ and $F_2$ within the interior of the slider $S_2$ moving to close the fastener F is illustrated in FIG. 7, in which the engaging prong 14 of the element 10 on one stringer $F_1$ moves around and in sliding contact with the outer surface of the front end wall 16 of the neighboring element 10 in the opposite mating stringer F2 and slips into the pocket 15 in the latter element. This coupling operation of adjacent elements 10 is facilitated by the provision of the guide slope 20 which permits movement of the prong 14 therealong into the pocket 15 with minimum frictional resistance.

The provision of the rib 21 is another feature of the invention in that it serves to reinforce the front end wall 16 of the element 10 which has been somewhat weakened as a result of forming the guide slope 20 at the outer surface of the wall 16.

Figure 9:
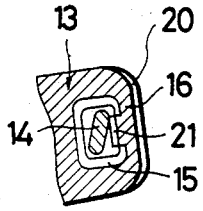
FIG. 9 is a cross-sectional view of a coupling head portion shown in the condition of FIG. 8.

The rib 21 provides sufficient reinforcement to retain the elements 10 stably in interengaged position against forces applied vertically upwardly (FIG. 8) as shown in FIGS. 8 and 9, or against lateral pull tending to spread apart the fastener stringers.

Although various minor modifications may be suggested by those versed in the art, it should be understood that we wish to embody within the scope of the patent warranted hereon, all such embodiments as reasonably and properly come within the scope of our contribution to the art.

What is claimed is:

1. A sliding clasp fastener of the type having a pair of sliders for opening and closing the fastener from either of two directions comprising a pair of identical stringers and a series of discrete coupling elements mounted one each of the respective stringers, said coupling elements each including, at one of its ends, leg portions defining therebetween an aperture, and at the opposite end a coupling head portion, said head portion having an engaging prong and a pocket complementary in shape with the contour of said prong, said head portion including a front end wall having an outer marginal surface facing away from said leg portions and extending contiguous to said engaging prong, and a substantially flat inner surface facing away from said outer marginal surface and defining a side of said pocket, said outer marginal surface having a portion sloping downwardly away from said pocket to form a guide slope, said head portion further including at least one reinforcement rib disposed exclusively on said flat inner surface and extending from an upper edge of said flat inner surface toward the bottom of said pocket, said reinforcement rib having a substantially uniform width throughout the length thereof and a flat top surface.

2. A sliding clasp fastener according to claim 1, said reinforcement rib terminating far short of the bottom of said pocket.

3. A sliding clasp fastener according to claim 1, including two said reinforcement ribs spaced laterally from one another and terminating in the bottom of said pocket.

* * * * *